US005272851A

United States Patent [19]

De La Fuente

[11] Patent Number: 5,272,851

[45] Date of Patent: Dec. 28, 1993

[54] IMPROVEMENTS TO THE DEVICES FOR REINFORCING CONCRETE IN COMPRESSION AND TO CONCRETE WORKS THUS REINFORCED

[75] Inventor: Carlos De La Fuente, Nanterre, France

[73] Assignee: Freyssinet International et Compagnie, Marseille, France

[21] Appl. No.: 902,236

[22] Filed: Jun. 22, 1992

[51] Int. Cl.[5] ..... E04C 2/04

[52] U.S. Cl. ..... 52/600; 52/223.6; 52/223.13; 52/583

[58] Field of Search ..... 52/727, 728, 723, 720, 52/600, 602, 309.16, 309.17, 601, 309.12, 583, 223.6, 223.13

[56] References Cited

U.S. PATENT DOCUMENTS

| | | | |
|---|---|---|---|
| 2,611,262 | 9/1952 | Dodson et al. | 52/223.13 |
| 2,857,755 | 10/1958 | Werth | 52/223.13 |
| 3,015,912 | 1/1962 | Fisteidis | 52/223.6 |
| 3,295,286 | 1/1967 | Schaich | 52/600 |
| 3,443,347 | 5/1969 | Varnell et al. | 52/309.16 |
| 3,952,468 | 4/1976 | Soum | 52/583 |

FOREIGN PATENT DOCUMENTS

| | | | |
|---|---|---|---|
| 928601 | 6/1949 | Fed. Rep. of Germany . | |
| 940608 | 3/1956 | Fed. Rep. of Germany . | |
| 1251505 | 10/1967 | Fed. Rep. of Germany . | |
| 2727698 | 2/1979 | Fed. Rep. of Germany . | |
| 2906797 | 9/1980 | Fed. Rep. of Germany | 52/600 |

*Primary Examiner*—Carl D. Friedman
*Assistant Examiner*—Kien Nguyen
*Attorney, Agent, or Firm*—Larson and Taylor

[57] ABSTRACT

This is a device for reinforcing a concrete member (1) in compression, comprising at least one bar (3) housed without adhesion in a channel (2) hollowed out in said member. Each of the two ends of the bar is associated with a device adapted to cause it to bear longitudinally on the concrete of the member. One of these two devices, which is associated with at least one ($3_1$) of the two ends of the bar (3) is a rigid frame (4) housed in a cavity (5) of the member accessible from the outside. The frame is arranged so as to receive in removable manner a thrust generator (7). One side of this frame having the bar end in question passing through it is arranged so as to interact with a unidirectional element (8) serving successively to cause the end to be pushed back by the thrust generator, and then to lock this end with respect to the frame in the direction corresponding to the return of the end into the frame.

10 Claims, 3 Drawing Sheets

FIG.1
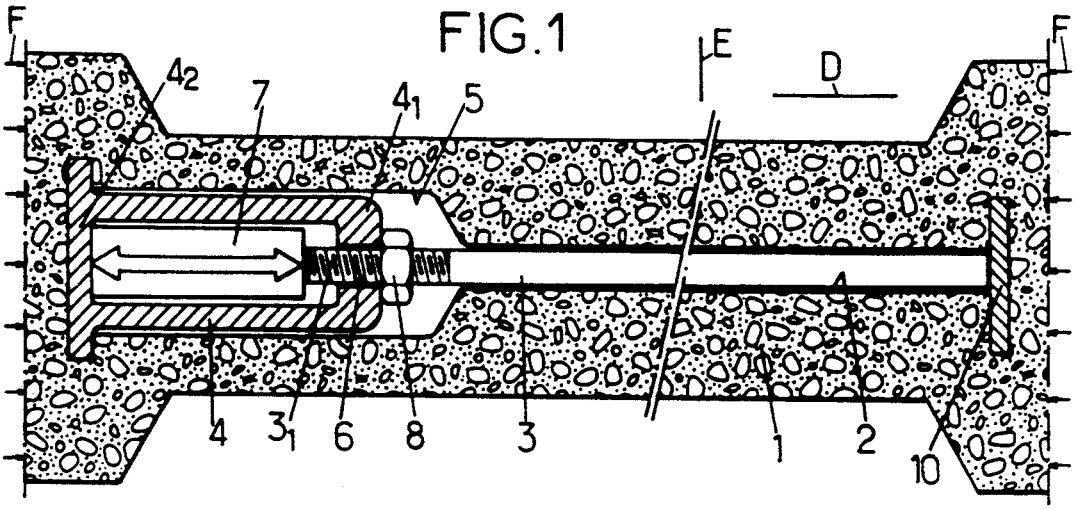
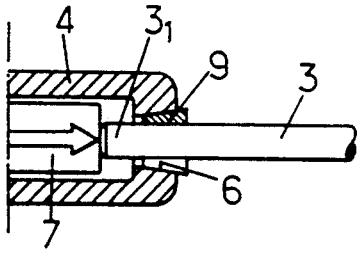
FIG.2.
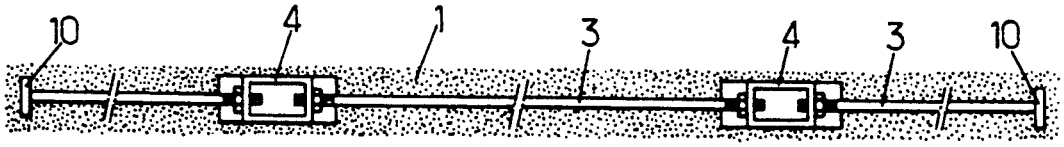
FIG.3.
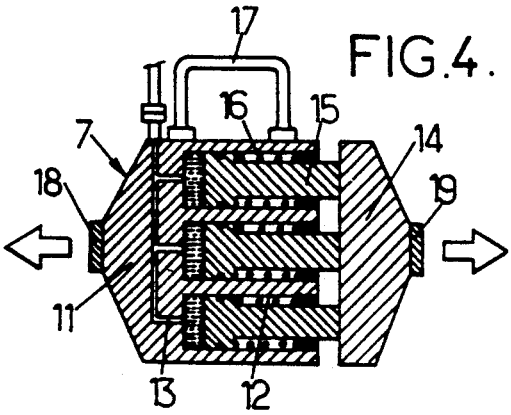
FIG.4.
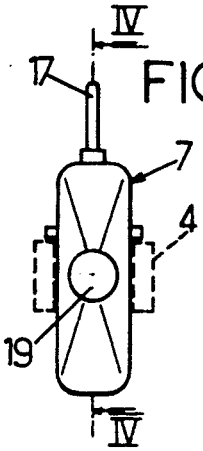
FIG.5.

IMPROVEMENTS TO THE DEVICES FOR REINFORCING CONCRETE IN COMPRESSION AND TO CONCRETE WORKS THUS REINFORCED

The invention relates to the processes and devices intended to reinforce a concrete member working in compression with the aid of at least one bar of metal or the like buried at least in part in this member and compressed longitudinally between its two ends to absorb part of the gross compressive force exerted on the concrete member leaving a smaller net compressive force.

This technique makes it possible to make the concrete member in question thinner—and ultimately to reduce its weight and its price—for a given value of its compression strength or to increase this strength for given dimensions of said member.

In the solutions which have been proposed hitherto for this concrete reinforcement technique, at least one of the two ends of the bar in question protrudes slightly outside the member to be reinforced and the longitudinal compression of the bar is exerted on this end protruding, in comparison with the other, rigidly attached in any desirable manner to another portion of the member in question.

This compression is created particularly with the aid of a heavy mass resting on said end if the bar in question is orientated vertically or, more generally, it is created with the aid of at least one stretched reinforcement extending parallel to the bar and whose two ends are anchored respectively on two blocks themselves rigidly attached to the two ends of said bar.

In the embodiments based on these solutions, the lengths of the reinforced concrete members and of the reinforcing bars are modest, and this for a certain number of reasons including the following:

in order to compress a bar by exerting a thrust on one of its ends, it is necessary for this bar to be provided, on the side of this end, with an excess length outside the concrete member, which excess length may perhaps buckle during the exertion of the thrust in question thereon, even if means are provided for preventing the bar from adhering to the wall of the channel which receives it in the concrete, the frictions between this bar and this wall are not negligible and reduce by degrees the transfers of thrust to be exploited: thus, if the bar is too long, the thrust exerted on one of its ends places it in compression over only a portion of its length.

The invention has the aim especially of remedying these various disadvantages by making it possible in particular to increase considerably the span of the compressed bars for reinforcing the concrete in compression and to compress these bars in a simple and accurately adjustable manner, without any risk of buckling, without recourse to auxiliary reinforcements and independently of the orientation of said bars.

To this effect, the devices for reinforcing a concrete element in compression according to the invention still comprise at least one bar resistant to longitudinal compression housed without adhesion in a channel hollowed out in the said member and are essentially characterized in that at least one of the two ends of the bar is associated with a rigid frame housed in a cavity of the member accessible from outside this member and arranged so as to receive in removable manner a thrust generator, one side of this frame being arranged so as to cause the bar to bear longitudinally on the concrete, directly or not, in the direction tending to separate this concrete from the bar and therefore to resist a thrust exerted in the opposite direction and its other side having the bar end in question passing through it and being arranged so as to interact with a unidirectional element serving successively to cause said end to be pushed back longitudinally in adjustable manner by the thrust generator, and then to lock this end with respect to the frame in the direction corresponding to the return of the end into the frame.

In advantageous embodiments, use is additionally made of one and/or other of the following provisions:

the bar end in question is threaded, the passing of this threaded end through the frame is effected with clearance in line with a smooth-surfaced bore and the unidirectional locking element is a nut screwed onto the threaded end outside the frame, the unidirectional locking element is a split jaw in the shape of a truncated cone having an outer surface in the shape of a truncated cone and having a cylindrical inner surface adapted to surround almost contiguously the bar end in question, and the passing of this bar through the frame is effected in line with a bore in the shape of a truncated cone adapted to receive contiguously said jaw, the side of the frame opposite that through which passes the bar end in question, itself has passing through it one end of another bar extending in the longitudinal extension of the first and interacts with a unidirectional locking element identical to that mentioned previously, the thrust element is a hydraulic jack, the hydraulic jack comprises a plurality of elementary jacks mounted in parallel so as to stress in mutual separation a casing comprising the cylinders of these elementary jacks and fitted with a handle and a compensation bar rigidly attached to the pistons of said elementary jacks, the assembly of the casing and of the compensation bar having the outer shape of a suitcase designed and dimensioned so as to be capable of being housed in easily removable manner in the frame with points for the casing and the compensation bar to bear respectively against the bar end to be compressed and the frame or the contiguous end of a second bar to be compressed.

The invention relates also to concrete works stressed at least locally in compression and reinforced by at least one device of the kind described above, and in particular :

to concrete bridge sections assembled by corbelling or cantilevering from a pier, sections which have an intrados reinforced in the manner indicated above, to concrete beams whose two ends rest respectively on two supports, beams which have an upper portion reinforced in the manner indicated above, and to concrete roadways which comprise, juxtaposed with a passive portion to be subjected to a horizontal longitudinal compression, at least one active portion reinforced in the manner indicated above.

The invention comprises, apart from these main provisions, certain other provisions which are preferably used at the same time and which will be dealt with more explicitly hereafter.

In the following, some preferred embodiments of the invention will be described with reference to the accompanying drawings in a manner clearly understood to be non-limitative.

FIG. 1, of these drawings, shows in cross-section a concrete member stressed in compression and reinforced by a compressed bar device set up according to the invention.

FIG. 2 shows a variant also according to the invention of a portion of the device of FIG. 1.

FIG. 3 shows in cross-section to a smaller scale another concrete member reinforced by a device according to the invention comprising several compressed bars mounted in series.

FIGS. 4 and 5 show, respectively, in cross-section along IV—IV of FIG. 5, and in end-view, a hydraulic jack according to the invention capable of forming part of the above reinforcement devices.

Figure 6:
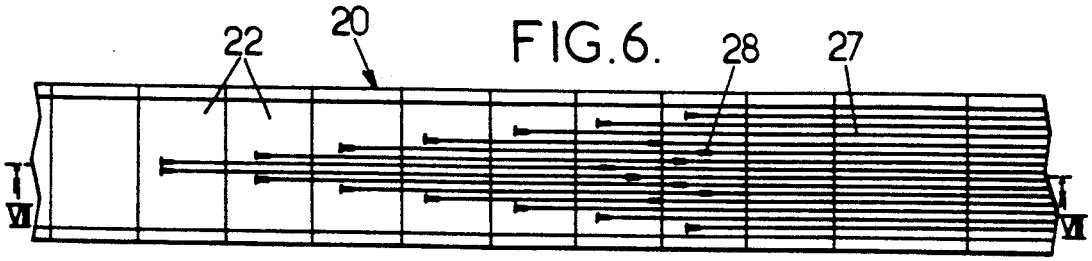
FIGS. 6, 7 and 8 show a portion of a corbelled bridge reinforced according to the invention, respectively in diagrammatic plan view, in vertical longitudinal cross-section along VII—VII of FIG. 6 and in transverse cross-section along VIII—VIII of FIG. 7.

In a general way, it is proposed to increase the compression strength of a concrete member 1 having a relatively large dimension in a direction D and in particular assuming the shape of a post, web or beam, said member having, at least locally, a relatively small dimension in a direction E perpendicular to D and being stressed in strong compression in this direction D, as shown diagrammatically by arrows F in FIG. 1.

For this purpose, there is hollowed out in the member 1 a cylindrical channel 2 extending in the direction D, whose cross-section, preferably circular, is only slightly greater than the cross-section of a metal bar 3 resistant to axial compression and this bar 3 is housed in this channel 2.

The length of the bar 3 is less than that of the member 1 so that neither of its ends protrudes outside this member.

Moreover, means are provided in order to cause the two ends of the bar 3 to bear longitudinally against portions, of the member 1, strongly stressed in compression in the direction of this bar and in order to stress said bar 3 in axial compression after its installation in the channel 2.

At one at least 3 of the two ends of the bar 3, the bearing in question is effected through the intermediary of a device which serves not only to take up the compression in question, but also to create the latter.

This device comprises essentially a rigid frame 4 housed in a cavity 5 hollowed out in the member 1 so that the space inside the frame is easily accessible from outside said member.

One of the sides 4 of the frame 4 is hollowed out by a bore 6 which itself has passing through it the end $3_1$ in question of the bar 3, which renders possible the direct longitudinal application of a thrust on this end from an appropriate jack 7 inserted in removable manner inside the frame 4.

Unidirectional locking means are additionally provided:

on the one hand in order to render possible the slight longitudinal displacements of the end $3_1$ of the bar 3 with respect to the frame 4 in the direction tending to remove this end from the frame, during the application thereon of the thrusts of the jack 7, and on the other hand in order to then lock said end with respect to the frame 1 in the direction of its return into the inside of the frame, so as then to render possible the relaxation and removal of the jack 7.

Two embodiments have been shown for these means for unidirectional locking of the end $3_1$ of the bar 3.

In the first embodiment shown in FIG. 1, the bore 6 has a smooth internal cylindrical surface, the end $3_1$ is threaded and can move freely in the bore 6 and a nut 8 having a thread complementary to that of the end $3_1$ is mounted on the latter just outside the frame 4.

From examining FIG. 1, it will be understood that, under these conditions, the end $3_1$ can be pushed back towards the right in order to be subjected to an axial compression and that, in order then to maintain the relative position obtained between the end $3_1$ and the frame 4 at the end of compression, it is sufficient to screw the nut 8 until its contact is obtained with the side $4_1$ of the frame 4.

In the second embodiment shown in FIG. 2, the bore 6 has an inner surface in the shape of a truncated cone diverging towards the outside of the frame 4, and the end $3_1$, then smooth or practically smooth, has been surrounded by a bush split longitudinally constituting an anchorage jaw in a manner well known per se, said bush having a cylindrical inner surface adapted to surround contiguously the end 3 and an outer surface in the shape of a truncated cone adapted to be housed contiguously in the complementary bore 6.

The number of the longitudinal slots in this edge is advantageously equal to 3, so that said jaw is composed of three identical keys.

By examining FIG. 2, the operation of such a mechanism will be easily understood: in all cases, that is to say whether the jaw 9 is driven in axially into its housing 6 or not, it is always possible to move the end $3_1$ of the bar 3 towards the right; but displacements of this end towards the left are prohibited as soon as the jaw 9 is in its driven-in position.

In one case as in the other, a good transfer of the axial thrusts between the bar 3 and the frame 4 is thus produced when the locking element (8, 9) is in its locking position.

As regards the bearing of the frame 4 against the concrete member 1, this can be achieved quite simply, as shown in FIG. 1, by widening the side $4_2$, of said frame, opposite the side $4_1$ so as to constitute a thrust plate directly buried in the mass of concrete stressed in compression.

According to an advantageous variant, the side $4_2$ in question is shaped in the same manner as the side $4_1$ and associated, like the latter, with one end of a bar disposed in the extension of the bar 3 and intended to operate like the latter in compression.

In this case, the frame 4 can be considered as a "coupler" between the two bars in question, adapted not only to transfer the compression forces from one bar to the other, but also to create this force from the jack 7.

It is such an assumption which was made in the version shown in FIG. 3, where are found mounted in series with the aid of two "couplers" 4 of the kind which has just been described, three successive bars 3 disposed in the mutual extension of one another.

It is of course possible to give the number of said "couplers" 4 a value greater than 2 which makes it possible to operate with "strings" of bars adapted to transfer a compression force to a great distance and therefore to reinforce with compressed bars, concrete works having dimensions very much larger than those hitherto reinforced by this technique, as will be explained hereafter in the context of several examples of applications.

In such strings of bars, the two ends of each of the intermediate bars are connected in the manner described above to link frames or couplers.

At each of the ends of such a string, are provided pressure distributor means which may again be constituted by terminal frames of the kind illustrated as 4 in FIG. 1 but which are preferably each constituted, more simply, by a rigid thrust plate 10 (FIGS. 1 and 3) disposed perpendicularly to the terminal bar 3 in question, and in juxtaposition against its end, said plate being buried in the concrete constituting the member 1 in a zone of the latter stressed in compression.

The plate 10 may be replaced at least in part by an adhesion produced over a sufficient length between the lateral surface of the section of bar close to the end in question and the surrounding mass of concrete.

As regards the jack 7, this is given a shape which can be easily handled and which is adapted to be inserted in an easily removable manner inside the frame 4.

In one advantageous embodiment shown in FIGS. 4 and 5, this jack is triple and comprises :

a casing 11 hollowed out by three cylinders 12 having parallel axes connected by appropriate ducts 13 to an external source of liquid under pressure (not shown), and a compensation bar 14 rigidly attached to three pistons 15 which are housed in leaktight manner in the cylinders 12 and are stressed so as to be driven in into these cylinders by springs 16 against the hydraulic pressure.

The casing 11 is fitted with a handle 17 permitting the assembly to be handled easily.

In the preferred embodiment shown, the frame 4 has a rectangular shape elongate in the directions of the bars 3, so that the sides $4_1$ and $4_2$ are the small sides of the rectangle, the axes of the elementary jacks 12, 15 composing the triple jack are disposed parallel with one another in the same plane parallel to the direction of insertion of this triple jack into the frame 4 and the assembly of said triple jack assumes the outer shape of a suitcase edged on its two end panels by thrust studs 18 and 19 as may be seen in FIGS. 4 and 5.

As regards the bars 3, they may be constituted by monobloc members, preferably enveloped in a thin protective tube, particularly of steel.

But the bars 3 may equally be constituted by bundles of wires or rods, round or not, the bundles themselves enveloped by protective tubes.

As a result of which, and whatever the embodiment adopted, a device is ultimately obtained comprising at least one compressed bar, serving to reinforce a concrete member stressed in compression, the constitution of which device is sufficiently established by the above.

In order to put to use such a device, it is sufficient to provide in a portion stressed in compression of a concrete member 1 to be reinforced at least one channel 2 extending in the direction of the compression and equipped with a bar 3 associated at one at least of its ends with a frame 4 of the kind described above housed in an appropriate cavity 5 of said member 1, the other end of said bar 3 being itself arranged so as to bear, directly or not, on a portion of the concrete member 1 in the direction opposite to the compressive stressing of this portion.

The compression of the bar 3 is then very easily obtained by inserting into the frame 4 an appropriate jack 7, by loading this jack so as to exert the desired thrust on the end $3_1$ of the bar 3, and then by locking the link between this bar and the frame 4, by relaxing the jack 7 and by disengaging it from the frame 4 and from the member 1.

The compression thus produced has many advantages in comparison with those previously proposed, particularly in that it does not require recourse to any bar end projecting outside the concrete member 1 nor to any auxiliary tension reinforcement and especially in that it renders possible the connection in series of a plurality of compressed bars 3, which enables concrete works of great length to be handled.

Several examples are given hereafter of reinforcement of such works.

Figure 7:
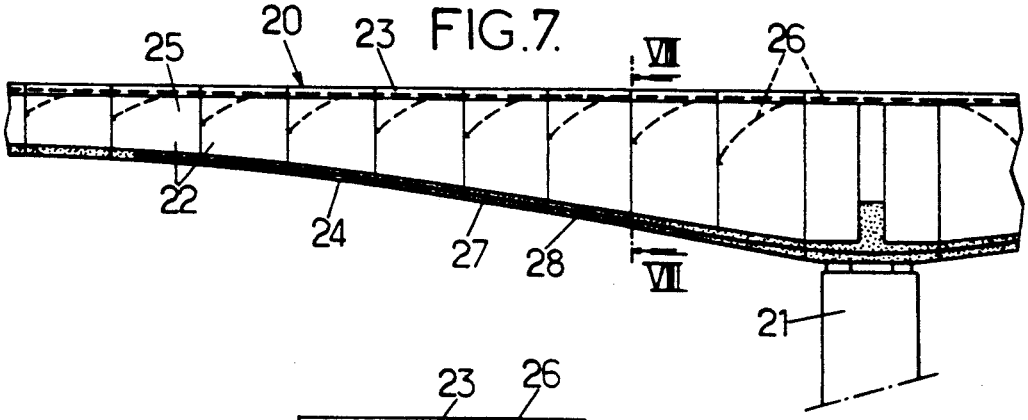
Figure 8:
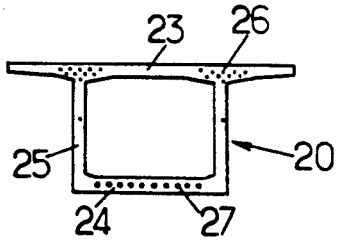

The first example shown in FIGS. 6 to 8 shows a concrete bridge section 20 assembled by corbelling, that is to say cantilevering, on a pier 21 and composed of successive voussoirs 22 added longitudinally against one another.

This bridge section comprises an upper slab 23 and a lower arch (or intrados) 24 which are braced by vertical webs 25.

The slab 23 which operates in tension is reinforced in a manner known per se by prestressing reinforcements 26 and the lower arch 24 is reinforced by longitudinal bars 27 which are associated with frames or "couplers" 28 of the kind described above and which are compressed in the manner described above.

Figure 9:
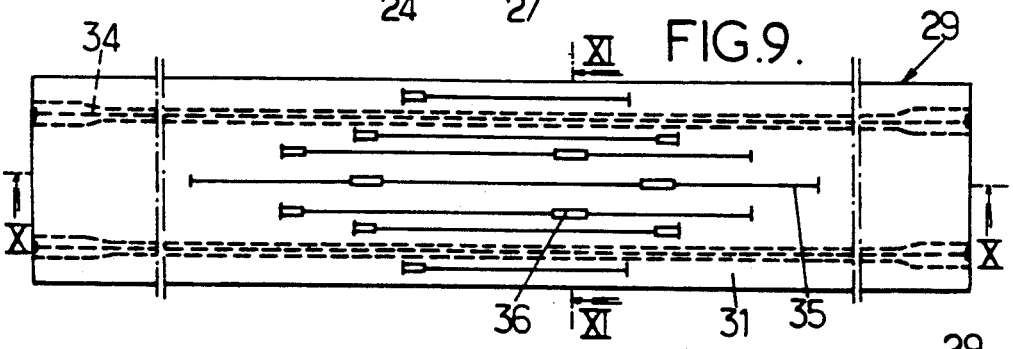
FIGS. 9, 10 and 11 show a concrete beam resting on supports at its two ends and reinforced according to the invention, respectively in diagrammatic plan view, in vertical longitudinal cross-section along X—X of FIG. 9 and in transverse cross-section along XI—XI of FIG. 9.
Figure 10:
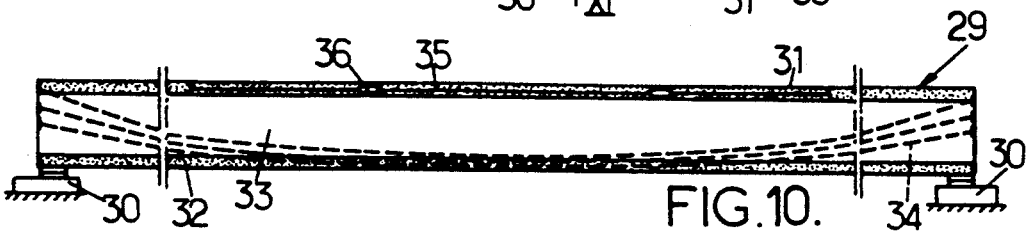
Figure 11:
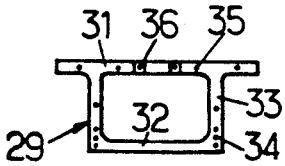

The second example shown in FIGS. 9 to 11 shows a concrete beam 29 the two ends of which rest on two supports 30 and which is composed of an upper deck 31 connected to a lower deck forming an intrados 32 by vertical webs 33.

The webs 33, the lower portion of which operates in tension, are reinforced in a manner known per se by prestressing reinforcements 34.

As for the upper deck 31, which operates in compression, it is reinforced by compressed longitudinal bars 35 associated with frames or "couplers" 36 as described above.

Figure 12:
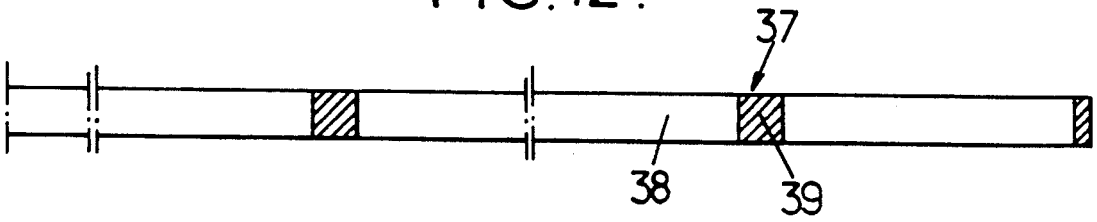
FIGS. 12, 13 and 14 show sections of roadway reinforced according to the invention, respectively in plan, in plan to a larger scale and in vertical cross-section to an even larger scale along XIV—XIV of FIG. 13.
Figure 13:
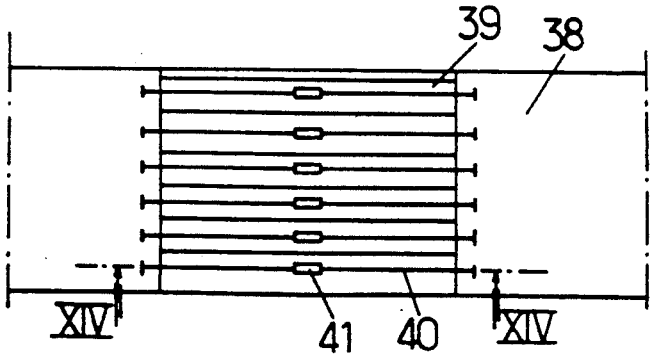
Figure 14:
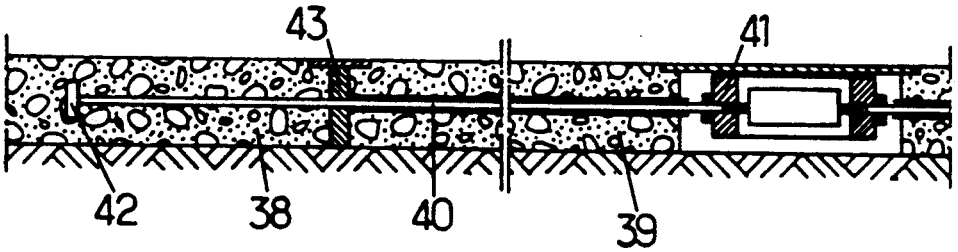

The third example shown in FIGS. 12 to 14 relates to a concrete roadway 37 composed of relatively long "passive" sections 38 between which are interposed shorter "active" sections 39.

The "passive" sections 38 are subjected to a longitudinal compression created at the level of the active sections by compressed longitudinal bars 40 associated with frames or "couplers" 41 of the type described above.

In this case, each bar 40 has one end associated with one of the couplers 41 disposed in an "active" section 39 and its other end is buried in an adherent manner in an adjacent passive section 38 and comes to butt against a vertical plate 42 buried in this section 38.

Appropriate joints 43 are of course interposed between the sections of roadway 38 and 39 so as to render possible their slight mutual deformations.

As it goes without saying, and as already established moreover from what precedes, the invention is by no means limited to those of the embodiments and applications which have been more specially described above;

on the contrary, it embraces all variants of them, particularly those where at least one of the compressed bars would be composed of several sections juxtaposed mutually end-to-end, the butted ends being in particular guided by a common rigid sleeve enveloping both of them.

I claim:

1. A system for providing a reinforced concrete element which is subjected to external compression comprising:

an elongate concrete member having a longitudinal channel and an open cavity adjacent to a portion of the channel;

a bar resistant to a longitudinal compression which is housed without adhesion in said channel, said bar having a first end and a second end;

an anchoring means for anchoring said first end of said bar against movement from a compressive force exerted on said bar;

a rigid frame housed in the open cavity which said rigid frame is accessible through the open cavity, said frame including a first side which bears longitudinally on a portion of said concrete member to hold said bar in compression and a second side through which said bar extends;

a thrust generator means which is received in a removable manner in said frame through said open cavity for exerting the compressive force on said second end of said bar relative to said anchoring means and said first side; and a holding means which engages said bar and said second side for holding said bar in compression after said thrust generator means is no longer exerting the compressive force and said thrust generator is thus removed from the open cavity.

2. A system for reinforcing a concrete member as claimed in claim 1 wherein said second end of said bar is threaded; wherein said second side includes a smooth bore through which said second end passes; and wherein said holding means includes a nut threaded on said second end of said bar.

3. A system for reinforcing a concrete member as claimed in claim 1 wherein said second side includes a bore having a truncated cone shape through which said second end passes; and wherein said holding means includes a split jaw having an outer surface which is truncated cone shaped complimentary to said bore so as to be contiguously received in said bore and an inner surface which is cylindrical and which contiguously surrounds said second end of said bar.

4. A system for reinforcing a concrete member as claimed in claim 1 wherein said first side of said frame includes a bore; and further including a second longitudinal channel extending parallel to said first-mentioned channel and away from said bore of said first side, a second bar in said second channel with a third end passing through said bore of said first side and a second holding means which engages said second bar and said first side for holding said second bar against a compressive force thereon.

5. A system for reinforcing a concrete member as claimed in claim 1 wherein said thrust generator means is a hydraulic jack.

6. A system for reinforcing a concrete member as claimed in claim 5 wherein said hydraulic jack is in the shape of a suitcase and includes a casing having a plurality of parallel cylinders therein, a handle, and a bearing point for engaging either of said second end of said bar or said first side of said frame, and a compensation bar having a correspond plurality of pistons attached thereto which are respectively received in said cylinders and a bearing point for engaging either of said second end of said bar or said first side of said frame.

7. A concrete work having a portion operating in compression comprising:

a reinforced concrete element which is subjected to the compression including (a) an elongate concrete member having a longitudinal channel and an open cavity adjacent a portion of the channel, (b) a bar resistant to longitudinal compression housed without adhesion in said channel, said bar having a first end and a second end, (c) an anchoring means for anchoring said first end of said bar against movement from a compressive force is exerted on said bar, (d) a rigid frame housed in the open cavity which said rigid frame is accessible through the open cavity, said frame including a first side which bears longitudinally on a portion of said concrete member to hold said bar in compression and a second side through which said bar extends, and (e) a holding means which engages said bar and said second side for holding said bar in compression after a thrust generator means which is received in a removable manner in said frame through said open cavity exerts the compressive force on said bar relative to said anchoring means and said first side; and a plurality of elements which exert a compression on said concrete element.

8. A structure as claimed in claim 7 which forms a concrete bridge section; wherein said elements include a pier and an upper slab cantilevered from said pier and operating under tension; and wherein said concrete element is an intrados which engages said pier and upon which said upper slab is mounted.

9. A structure as claimed in claim 7 which forms a concrete beam; wherein said elements include two spaced apart supports and a lower portion supported by said supports; and wherein said concrete element is an upper portion attached to said lower portion.

10. A structure as claimed in claim 7 which forms a concrete roadway; wherein said elements include spaced apart passive roadway portions; and wherein said concrete element includes an active portion located between said passive portions.

* * * * *